US005724748A

United States Patent [19]

Brooks et al.

[11] Patent Number: 5,724,748

[45] Date of Patent: Mar. 10, 1998

[54] APPARATUS FOR PACKAGING CONTAMINANT-SENSITIVE ARTICLES AND RESULTING PACKAGE

[76] Inventors: Ray G. Brooks; Timothy W. Brooks, both of 2505 Custer Ct., Irving, Tex. 75062; Stephen L. Fowler, 3551 Moore-Duncan Hwy., Moore, S.C. 29369

[21] Appl. No.: 685,697

[22] Filed: Jul. 24, 1996

[51] Int. Cl.[6] ..... F26B 19/00

[52] U.S. Cl. ..... 34/90; 34/218

[58] Field of Search ..... 34/548, 60, 61, 34/79, 90, 92, 202, 210, 218, 219, 221; 206/711, 213.1; 414/217, 416, 939; 141/85, 98

[56] References Cited

U.S. PATENT DOCUMENTS

| | | | |
|---|---|---|---|
| 5,295,522 | 3/1994 | DeAngelis et al. | 141/98 |
| 5,351,415 | 10/1994 | Brooks et al. | 34/60 X |
| 5,359,785 | 11/1994 | Fukutomi et al. | 34/60 |
| 5,472,086 | 12/1995 | Holliday et al. | 206/711 |
| 5,561,915 | 10/1996 | Vandergriff | 34/201 |
| 5,628,121 | 5/1997 | Brooks et al. | 34/61 |

FOREIGN PATENT DOCUMENTS 402065233A 3/1990 Japan .

*Primary Examiner*—Henry A. Bennett
*Assistant Examiner*—Steve Gravini
*Attorney, Agent, or Firm*—Geoffrey A. Mantooth

[57] ABSTRACT

A package for storing contaminant-sensitive articles in a contaminant-free environment featuring a pair of polymeric material circular half-sections having a bottom wall and a side wall. The half sections are arranged for overlying ans sliding engagement from a spaced-apart, open position into a stop position with the side walls in a telescoping relationship to form a closed enclosure having an interior for accommodating one or more contaminant-sensitive articles. Other features include: sealing means operatively associated with at least one of the side walls for sealing the enclosure interior in the stop position, resilient clamping means or latch mechanism on the half-sections for yieldingly urging the half-sections into the stop position against the sealing means to seal the enclosure interior, means for drawing a vacuum on the enclosure, and means on the enclosure for introducing a purging ionizing gas into the sealed enclosure interior to move the half-sections out of the stop position against the clamping means to thereby relieve excessive gas pressure in the enclosure interior.

14 Claims, 7 Drawing Sheets

APPARATUS FOR PACKAGING CONTAMINANT-SENSITIVE ARTICLES AND RESULTING PACKAGE

FIELD OF THE INVENTION

This invention relates to the elimination of the contamination of contaminant-sensitive articles stored in sealed plastic containers and more particularly to a method, apparatus and package for removing such contaminants as moisture, oxygen, ion contaminates and the like from the container interior and maintaining the interior contaminant-free for an indefinite period of time so as to increase productive yields between manufacturing steps by eliminating environmental variations.

DESCRIPTION OF THE PRIOR ART

Rapidly developing technology in the manufacturing of contaminant-sensitive articles such as semiconductor wafers has placed ever higher requirements on the elimination of contaminants. The ever increasing sensitivity of such wafers has made the presence of even infinitesimal amounts of contaminants a drawback to quality production and the elimination of rejects.

Myriad sources of such contaminants are always present. One such source is the plastic particles or shavings formed when the sharp edges of the wafers scrape or rub against the plastic wafer supports. Another source is ion contaminants from containers formed of polymeric material such as plastic bags, boxes and the like. Such ion contaminants migrate to wafer surfaces and can cause circuit degradation due to caustic and/or corrosive elements such as CL, PO4, NO3, Na and K found in polymeric material. Such polymeric material tends to "outgas" so that these elements become mobile with environmental moisture and are attracted to the surface of the wafers. It is therefore highly desirable to package such articles in sealed plastic enclosures devoid of contaminant activity to the greatest extent possible.

One form of protection has been the use of a dessicant prepackaged in a vapor transmission type material which is placed within the plastic enclosure prior to sealing. This dessicant or "getter" acts to absorb the atmospheric contaminants such as moisture and oxygen during packaging and storage. Such dessicants generally include Silica Gel and molecular sieves used for absorbing moisture and ferrous shavings such as iron bits for absorbing oxygen. For further enhancing the removal of such contaminants, the enclosure interior is frequently purged with an inert gas and evacuated prior to sealing.

In spite of all such prior art efforts, it has been found that undesirable contamination of the packaged sensitive articles still occurs to some extent for two reasons. First, present-day sealing apparatus depends on a negative pressure for the sealing operation. Consequently, the lack of a positive shut-off arrangement allows atmospheric contaminants to remain in the enclosure after sealing. In addition, all polymeric material from which such bags and boxes are constructed have some Water Vapor Transmission Rate(WVTR) causing penetration of moisture and other contaminants through the enclosure wall which dessicants are intended to remove.

Although removal of such contaminants is generally effective, the shelf-life of all packaged dessicants is limited and when such shelf-life is exceeded, further contaminant elimination is non-existent unless resort is had to the time consuming and expensive practice of repackaging and replacement. Furthermore, when such dessicants are used for packaging articles, improper handling of dessicants by personnel including storage prior to use, can reduce the efficacy of such dessicants.

Another contamination problem is presented even if the wafers are packaged at the production site in a contaminant-free environment. It has been proven that contamination levels over prolonged periods of time vary due to such factors as the materials used, ambient storage conditions such as pressure, temperature, vibration, moisture concentration as well as package sealing techniques.

Such contamination levels are not consistent and since it would be impractical cost-wise to measure contamination on a semi-continuous or continuous basis, the ultimate user must deal with such inconsistencies or variations adding to manufacturing costs. Such increased costs at the point of use arise from the need for cleaning the wafers which may or may not eliminate the contaminants on the wafers. Thus, what might be referred to as "Wafer Environment Control" (WEC) becomes a vital consideration. Such variations are "money" to the user since they impact on subsequent processes and possibly the yields of the final product or semiconductor that is being produced on the wafer.

There is the additional problem of particles which may be either free agents or particles produced by the sharp edges of packaged wafers rubbing against the plastic surfaces on which the wafers are supported in the package such as shock absorbers or the like. Such particles are another factor concerning WEC due to variables from lot to lot.

In summary, myriad sources of contamination are present for contaminant-sensitive articles packaged in enclosures of polymeric material which include the continuous production of ion contaminants by polymeric material whose mobility is primarily dependent on moisture. In addition, penetration of water vapor through the polymeric material into the enclosure interior, improper handling and sealing of the enclosure and the limitation of the effectiveness of dessicants over the long term when extended storage periods are encountered.

SUMMARY OF THE INVENTION

Accordingly, a primary object of the invention is to provide a new and novel method and package for packaging contaminant-sensitive articles such as semiconductor wafers in a contaminant-free environment.

Another object of the invention is to provide a new and novel method and package for maintaining packaged contaminant-sensitive articles in a contaminant-free environment for prolonged periods of time.

A further object of the invention is to provide a new and novel package for contaminant-sensitive articles such as semiconductor wafers which maintains the package in a sealed condition while permitting the flow of a purging gas and entrained contaminants therefrom.

A still further object of the invention is to provide a new and novel apparatus for automatically purging and/or evacuating the interior of a sealed package of contaminant-sensitive articles such as semiconductor wafers while maintaining the package in a sealed condition.

Still another object of the invention is to provide a new and novel package for contaminant-sensitive articles is of multi-enclosure construction comprising two or more sealed enclosures the interiors of which may be subjected simultaneously to a purging and/or evacuating process to maintain the interiors in a contaminant-free condition.

A still further object of the invention is to provide a new and novel package for contaminant-sensitive articles which permits removal of contaminants anytime after original packaging while maintaining the package in a sealed, moisture-free environment.

Still another object of the invention is to provide a new and novel apparatus and package for contaminant-sensitive articles which maintains the articles free of contaminants during the loading of such articles in the package.

The objects of the invention and other related objects are accomplished by the provision of a sealed plastic enclosure in the interior of which are packaged one or more contaminant-sensitive articles such as semiconductor wafers which are free of contaminants during the loading of such articles in the package wherein the enclosure comprises a pair of half-sections yieldingly retained in sealing engagement together with means for subjecting the interior to a purging gas and/or a vacuum from an associated apparatus with the interior being maintained in a sealed condition but permitting the release of purging gas with entrained contaminants from the interior during the purging operation, the enclosure being adapted to be contained within one or more concentric surrounding flexible plastic bags having interiors adapted to be subjected to a purging and/or evacuating operation.

DESCRIPTION OF THE PREFERRED EMBODIMENTS

Figure 1:
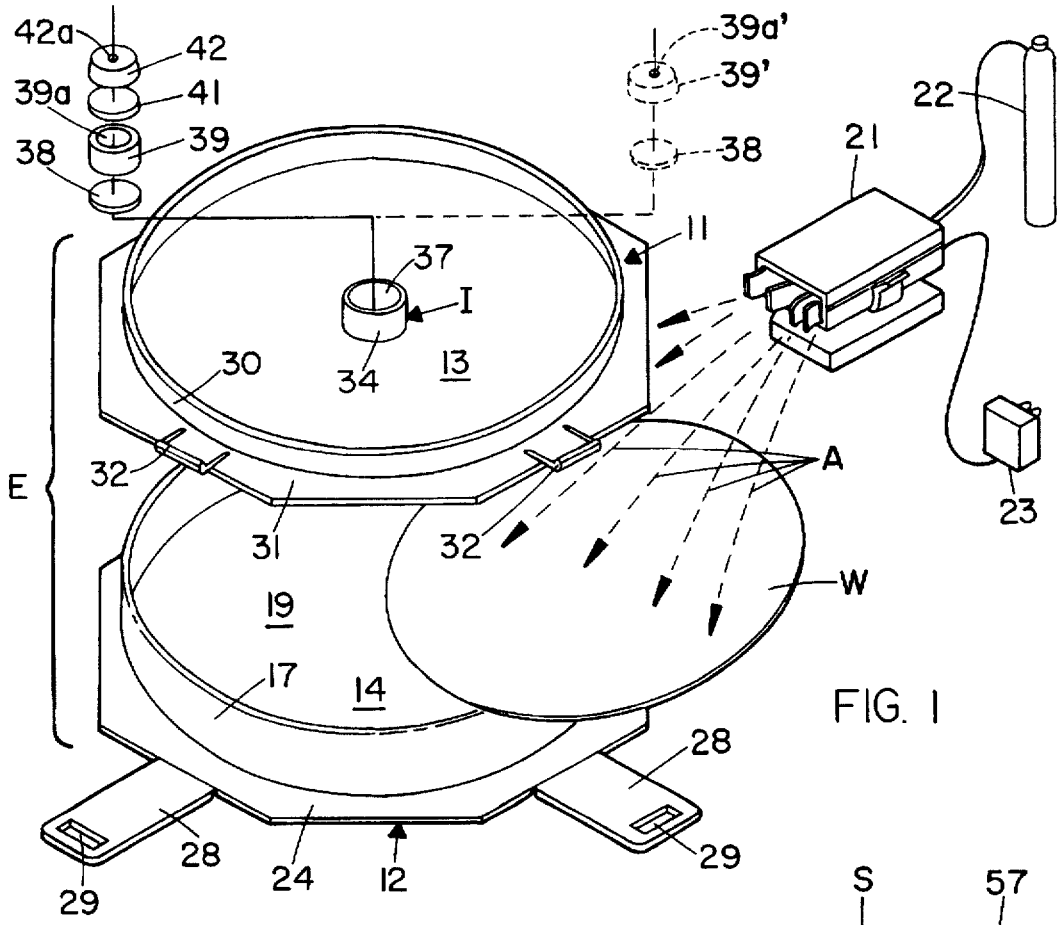
FIG. 1 is an exploded view of the packaging method of the invention illustrating one of the steps in the novel process of the invention.
Figure 2:
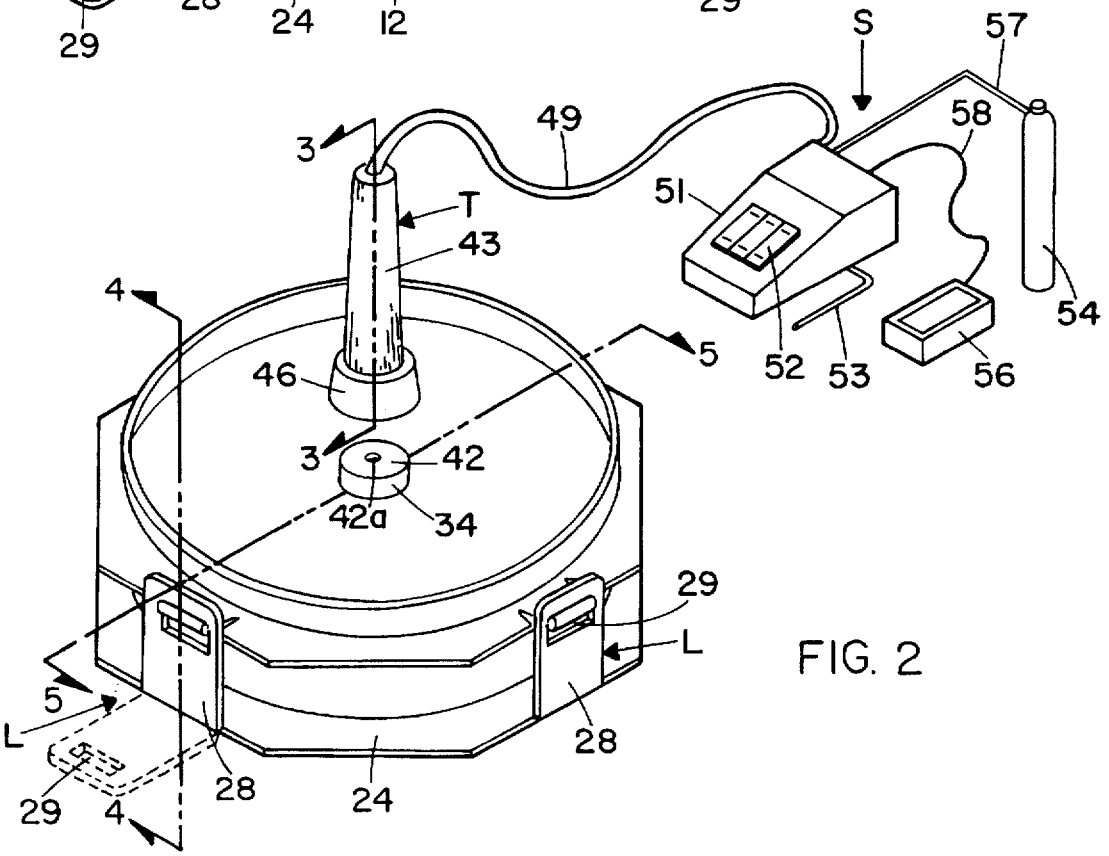
FIG. 2 is a schematic view of the enclosure of the invention in association with purging and evacuating apparatus.

Referring now to the drawings and to FIGS. 1, 2 in particular, there is shown an enclosure or box constructed in accordance with the invention and designated generally by the letter E. The enclosure E is preferably molded of synthetic resinous material such as polypropylene and is adapted for the packaging of contaminant-sensitive articles such as semiconductor wafers W.

More specifically, the enclosure E comprises a pair of half-sections 11, 12 each having a bottom wall 13, 14 and a side wall 16, 17 respectively. In the illustrated embodiment, the enclosure E is preferably of circular cross-sectional shape with upstanding annular side walls 16, 17. However, it should be understood that the enclosure E may be of any desired shape.

Figure 4:
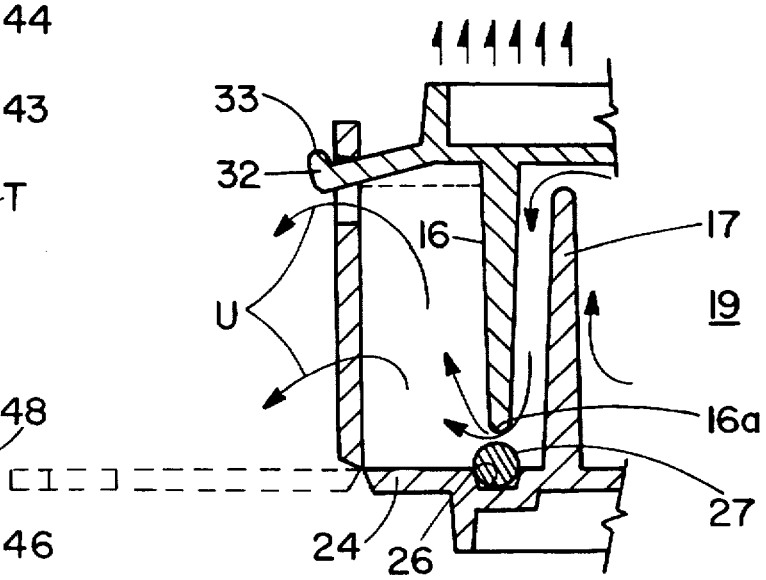
FIG. 4 is an enlarged sectional view taken substantially along line 4—4 of FIG. 2 in the direction of the arrows.

The half-sections 11, 12 are arranged for overlying, sliding engagement from a spaced-apart, open position as shown in FIG. 1 into a stop-position as shown in FIG. 2 with the side walls 16, 17 in telescoping relationship as shown in FIG. 4 to form the enclosure E having an interior 19. Thus, in the open position of FIG. 1, the articles W may be introduced between the half-sections 11, 12 so as to be accommodated within the enclosure interior 19.

As shown in FIG. 1, means are provided for bathing the articles W introduced into the enclosure E with an ionizing gas thereby eliminating static charges on the articles which would otherwise serve to attract contaminants such as particles. More specifically, as shown in FIG. 1, an ionizer 21 is operatively associated with the enclosure E and produces an ionizing gas which continuously envelops the wafers W and adjacent enclosure parts as indicated by the arrows A. As shown, the ionizer 21 is connected to a source 22 of ionizing gas and a source of electric power 23.

Sealing means operatively associated with at least one of the side walls 16, 17 are provided for sealing the enclosure interior 19 in the stop or closed position of FIG. 2. As shown best in FIG. 4, the half-section 12 is provided with a peripheral flange 24 in which is formed an annular groove 26. An O-ring 27 is disposed within the groove 26 adjacent the side wall 17 for sealing engagement with the upper edge **16*a* of the side wall 16 of the half-section 11 as shown in FIG. 5**.

Figure 5:
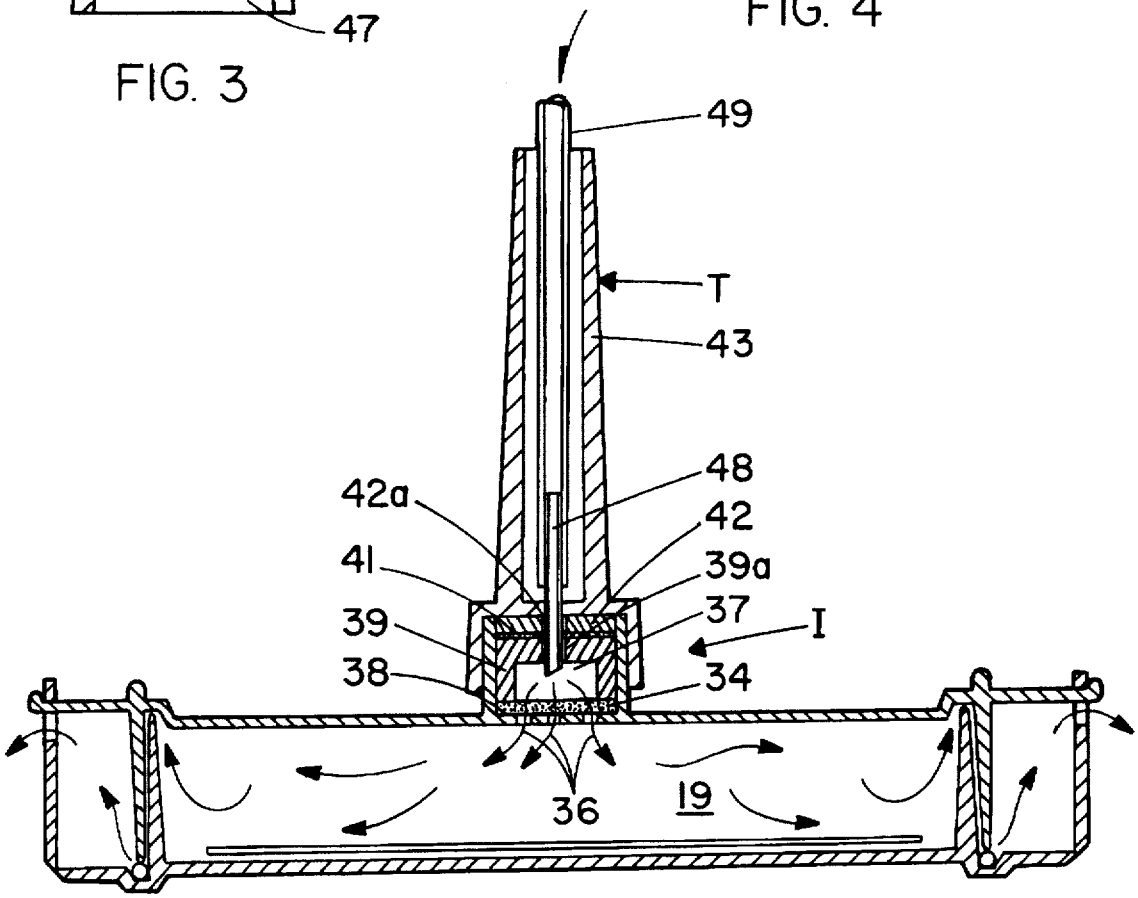
FIG. 5 is an enlarged sectional view taken substantially along line 5—5 of FIG. 2 in the direction of the arrows.

Resilient clamping means are provided on the half-sections 11, 12 for yieldingly urging the half-sections into the stop or sealing position of FIG. 5 to seal the enclosure interior 19. More specifically, a plurality of circumferentially spaced latches designated generally by the letter L are provided on the enclosure E each of which includes a pivotally movable latch member 28 preferably formed integrally with the flange 24 in half-section 12. The distal end of each of the members 28 is provided with a slot 29.

The half-section 11 is also provided with an upstanding, annular flange 30 and a peripheral flange 31 on which are provided a plurality of catch members 32 perferably formed integrally with the flange 31 and spaced circumferentially for operative association with an adjacent latch member 28. Thus, as shown best in FIG. 5, the half-sections 11, 12 are latched together by upward movement from the dotted line position of FIG. 2 of the latch members 28 for engagement of the catch members 32 with the slots 29 of the associated latch member 28. This latching action yieldingly urges the upper edge **16*a* of side wall 16 against the O-ring 27 thereby providing a sealed interior 19 for the enclosure E. To releasably retain the latches L in the locked position, the outer end of each of the catch members 32 is provided with an upstanding bead 33**.

Means are provided for introducing a purging gas into the interior 19 of the sealed enclosure E and to move the half-sections 11, 12 out of the stop position of FIG. 5 against the clamping action of the latches L as shown in FIG. 4 thereby relieving excess gas pressure in the enclosure interior 19 during the purging operation. More specifically, as shown in FIGS. 1, 5, the bottom wall 13 of the half-section 11 is provided with an inlet port designated generally by the letter I. The inlet port I includes an upstanding, central sleeve 34 preferably formed integrally with the bottom wall 13. Openings 36 are also provided within the area of the wall 13 defined by the sleeve 34.

The sleeve 34 includes a central bore 37 in which is positioned a stacked assembly including a filter 38, a filter retainer 39 having a central opening 39*a*, a patch 41 of self-sealing material such as rubber and a patch retainer 42 having a central opening 42*a*, as shown in FIG. 5 and as shown in the exploded solid line assembly of FIG. 1.

Referring now to FIG. 2, a purging gas as well as a vacuum is introduced selectively within the sealed enclosure from an associated fluid pumping source designated generally by the letter S and including a source of purging gas and a vacuum source.

Figure 3:
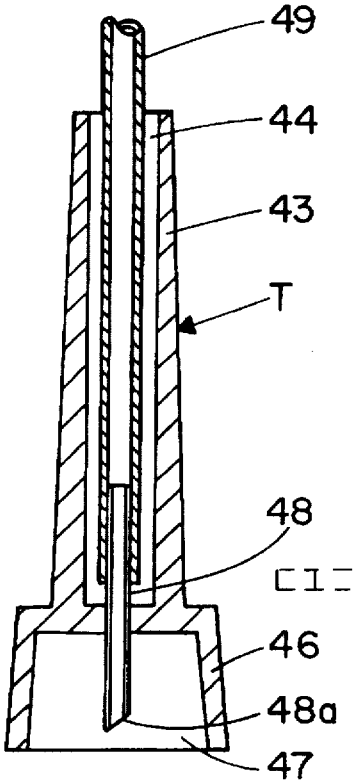
FIG. 3 is an enlarged sectional view taken substantially along line 3—3 of FIG. 2 in the direction of the arrows.

More specifically, as shown best in FIGS. 3, 5, a manually manipulated wand T is provided which includes an elongated body portion 43 having a central bore 44 terminating at one end in a cup portion 46 defining a recess 47. A hollow instrument such as a needle 48 having a sharp outlet end 48*a* is supported within the wand T with opposite end portions extending within the bore 44 and cup recess 47 respectively.

The needle 48 is connected by means of a hose 49 to the fluid pumping source S including a program controller 51 having a timing means 52. The controller 51 is connected to a source of electric power by means of conductors 53 and to a source 54 of purging gas and a vacuum source 56 by means of hoses 57, 58 respectively.

The introduction of purging gas within the enclosure interior 19 is accomplished by positioning the wand T as shown in FIG. 2 with the sleeve 34 of the inlet port I snugly accommodated within the wand recess 47 as shown in FIG. 5. In this position, the needle's distal portion extends through the apertures 42*a*, 39*a* in the patch retainer 42 and filter retainer 39 respectively piercing the patch 41. The needle outlet 48*a* is thus disposed within the wand recess 47 so that purging gas from system S can be introduced into the enclosure interior 19 to bathe the contaminant-sensitive articles therein.

If there is a buildup of excessive purging gas pressure within the enclosure interior 19, the half-sections 11, 12 move apart to lift the upper edge 16*a* of side wall 16 from the O-ring 27 providing a path for gas with entrained contaminants to escape from the enclosure E to the exterior around the side wall 16 as indicated by the arrows U in FIG. 4. In addition to a purging operation, the the enclosure interior 19 may also be subjected to a vacuum as established by the controller 51 in any desired sequence and duration in accordance with a program preset with the controller's timing means 52.

After termination of the purging and/or vacuum operations, the wand T is removed withdrawing the needle 48 following which the patch 41 reseals maintaining the enclosure interior 19 in a sealed condition free of contaminants.

Figure 7:
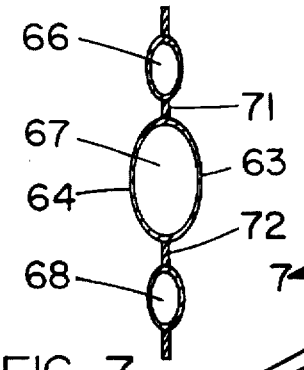
FIG. 7 is a sectional view taken substantially along line 7—7 of FIG. 6 in the direction of the arrows.
Figure 6:
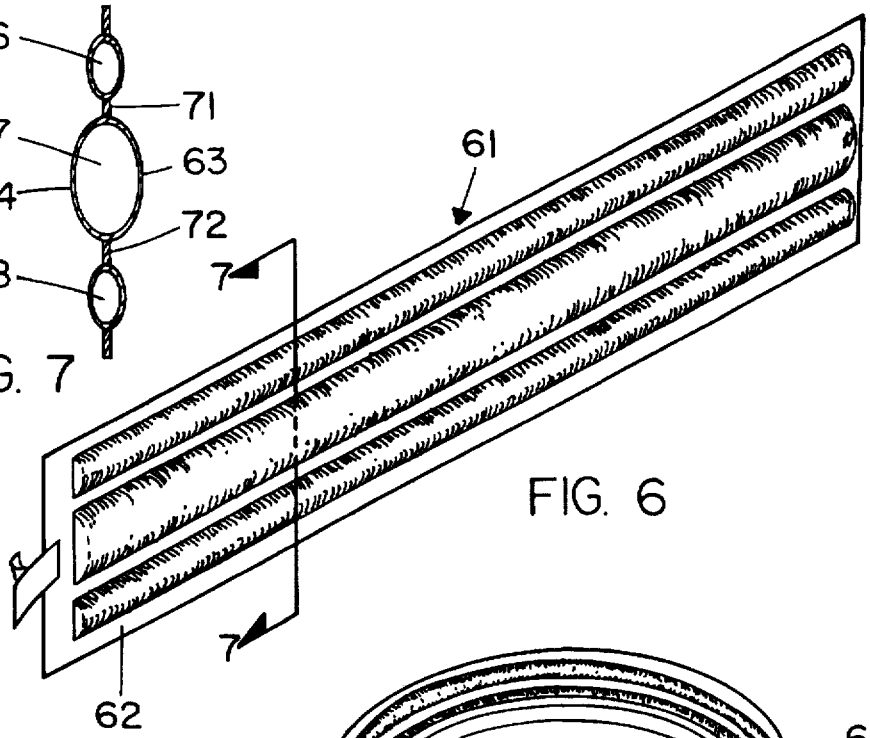
FIG. 6 is a perspective view of a barrier strip detachably attached to the enclosure of FIG. 1.
Figure 8:
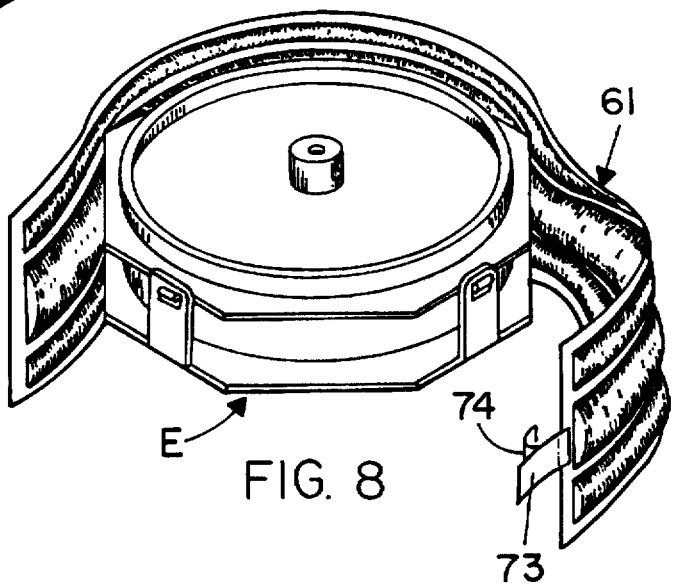
FIG. 8 is a perspective view of the enclosure of FIG. 1 illustrating the attachment of the barrier strip of FIG. 6.
Figure 9:
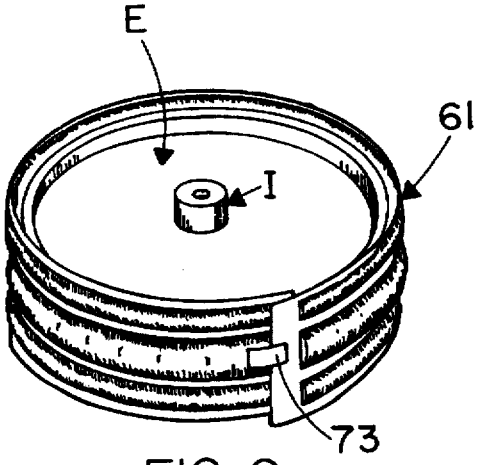
FIG. 9 is a perspective view of the enclosure of FIG. 1 together with the attached barrier strip of FIG. 6.

The enclosure E may be further protected by means for externally enclosing a side portion of the enclosure E. More specifically, as shown best in FIGS. 6–9, an elongated pad or barrier strip 61 of rectangular configuration is provided which may be of any suitable airtight material such as plastic or the like. The pad 61 includes a strip 62 having side walls 63, 64 defining one or more inflated, longitudinally extending air chambers. In the illustrated embodiment, three of such chambers 66, 67, 68 are provided interconnected by webs 71, 72 as shown best in FIG. 7. Preferably, the width of pad 61 is slightly in excess of the height of enclosure E and of a length having overlapping end portions in the mounted position of FIG. 9.

As shown, the pad 61 is mounted in encircling relationship with the enclosure E and is retained in the mounted position by means of an adhesive tab 73 having a removable strip 74 of release material. In the mounted position of FIG. 9, the pad 61 not only provides a means of shock protection for the enclosure E but further reduces the water vapor transmission rate(WVTR).

Figure 10:
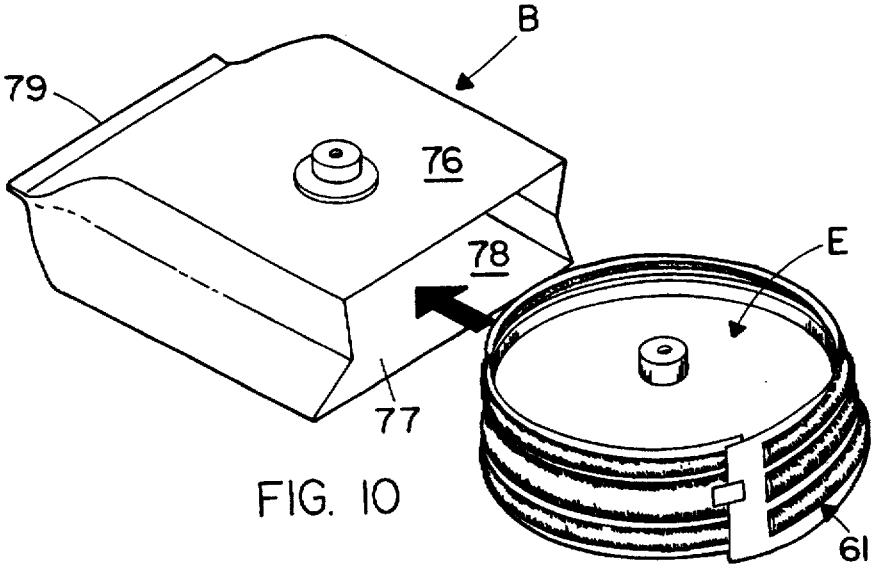
FIG. 10 is a perspective view illustrating the packaging of the enclosure of FIG. 9 within the interior of a second enclosure.

Referring now to FIGS. 10–13, wherein like numerals are used to identify like parts, further enclosure means may be provided for the enclosure E. In the illustrated embodiment, a flexible enclosure or bag of plastic material is provided which is identified generally by the letter B. The bag B includes side walls 76, 77 defining an interior 78. As shown in FIG. 10, the bag B is sealed at one end 79 and the other end is open to permit the insertion of the enclosure E with pad 61 within the bag interior 78, the open end being subsequently sealed at 80. This combination of the bag B and enclosure E forms a sealed package P.

Figure 13:
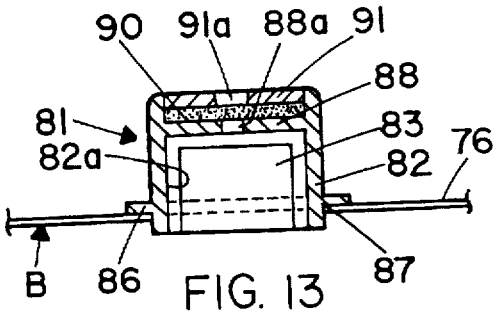
FIG. 13 is a sectional view taken substantially along line 13—13 of FIG. 12 in the direction of the arrows.

As shown best in FIG. 13, the bag B is provided with an inlet port 81 which includes an upstanding sleeve 82 having a central bore 83 suitably secured by means of a flange 86 within an opening 87 in the side wall 76 of the bag B. The sleeve 82 includes a transversely extending inner wall 88 having an aperture 88*a* over which is disposed a self-sealing patch 90 of rubber or the like and a disc retainer 91 having a central aperture 91*a* as shown best in FIG. 13. The inner wall 82*a* of the sleeve 82 is provided with a plurality of circumferentially spaced notches 93 for a purpose to be explained hereinafter.

Figure 11:
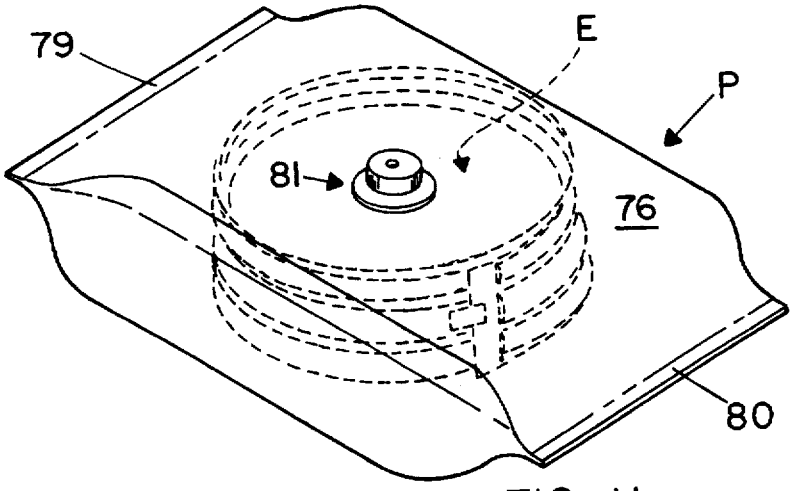
FIG. 11 is a perspective view of a package constructed in accordance with the invention utilizing the components of FIG. 10.
Figure 12:
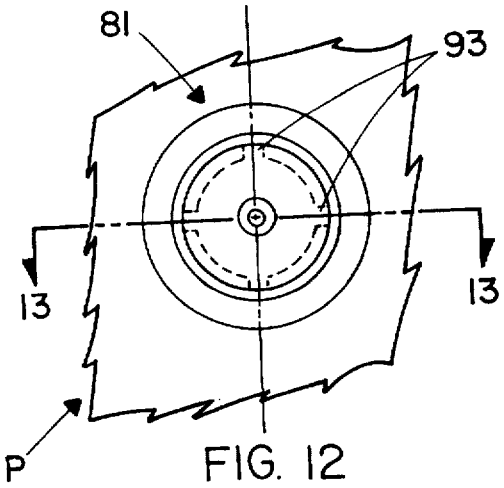
FIG. 12 is an enlarged plan view of a portion of the package of FIG. 11.
Figure 14:
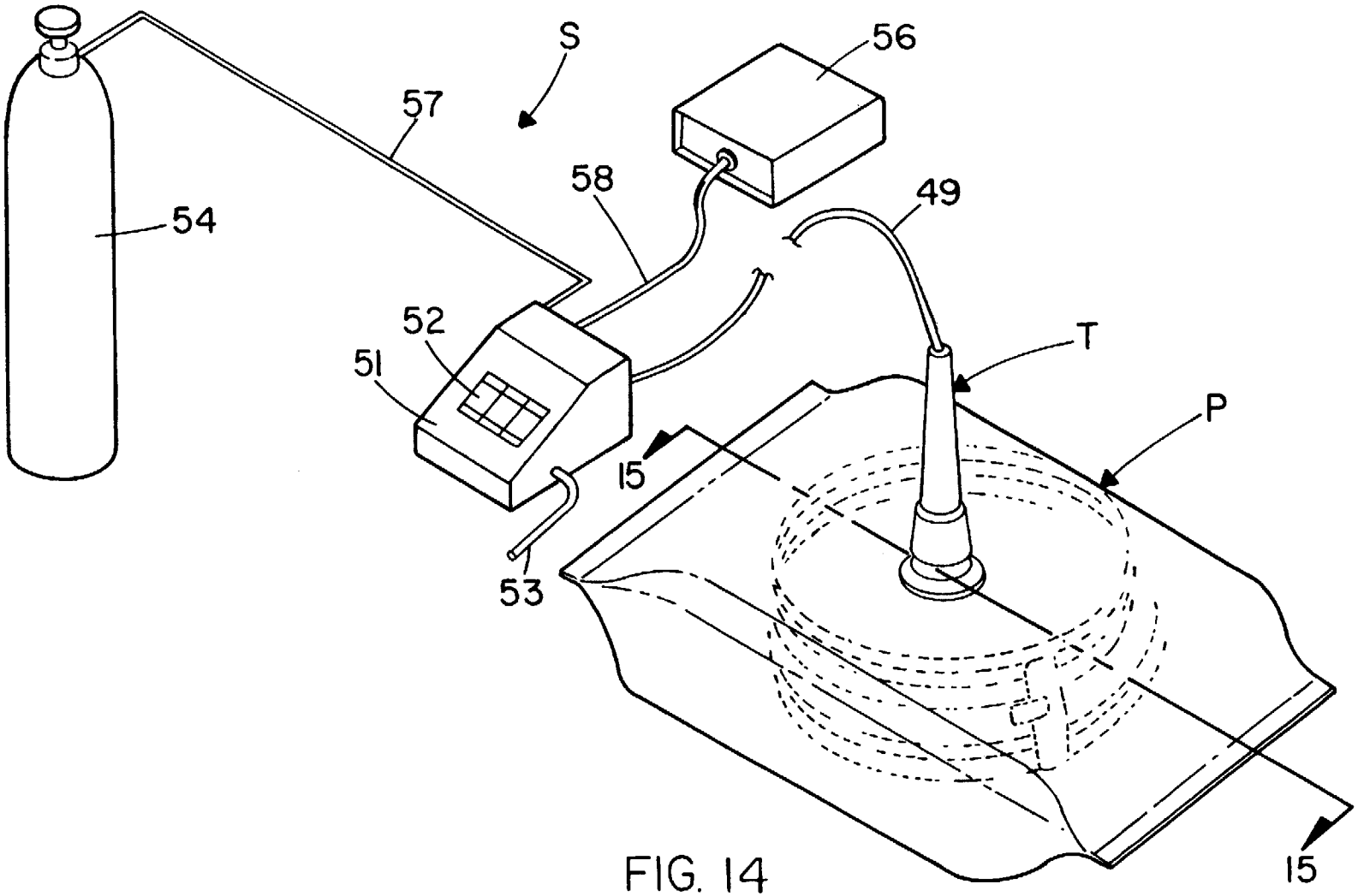
FIG. 14 is a perspective view of the package of FIG. 11 in association with the purging and evacuating apparatus of the invention.
Figure 15:
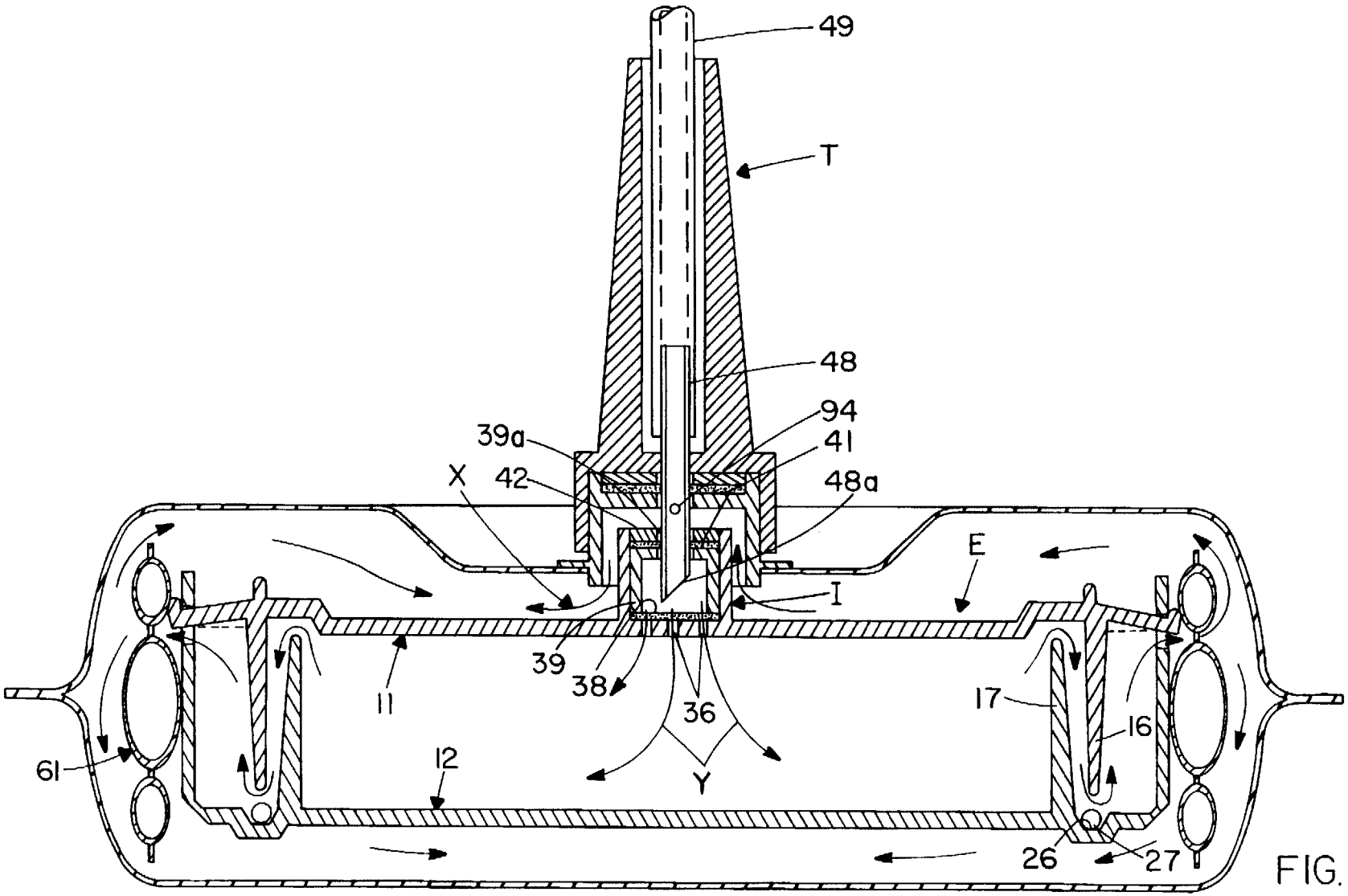
FIG. 15 is a sectional view taken substantially along line 15—15 of FIG. 14 in the direction of the arrows.

Referring now to FIGS. 14, 15 wherein like numerals are used to identify like parts, the sealed package P of FIG. 11 may now be subjected to a purging and/or evacuating operation in association with the fluid pumping system S. In the processing of the package P, the wand T of the previous embodiment has been modified and identified as wand T' which includes a side outlet port 94 as shown in FIG. 15.

As shown in FIG. 15, the inlet port 81 of bag B is centrally located so that in the assembled relationship of bag B and enclosure E, the inlet port I of enclosure E is received within the central bore 83 of sleeve 82 of the bag inlet port 81. In the operative position of wand T' on the bag inlet port 81, the inlet port 81 is received within the wand recess 47. The needle 48 passes through apertures 88*a*, 91*a* on the inlet port 81 of bag B and through apertures 42*a*, 39*a* on the enclosure E piercing both rubber patches 41, 90 on the enclosure E and bag B respectively.

In the position shown in FIG. 15, the needle side port 94 communicates only with the interior 78 of bag B through notches 93 and the needle outlet end 48*a* communicates only with the enclosure interior 19 through filter 38 and openings 36 in the bottom wall 13 of half-section 11. In the purging operation performed as shown in FIG. 15, the gas flow into the bag interior 78 is designated by the arrows X and the gas flow into the enclosure interior 19 is designated by the arrows Y. The excessive gas pressure relief within the enclosure interior 19 is accomplished as in the previous embodiment with the relative movement of the half-sections 11, 12 as permitted by the yieldable latches L.

Figure 16:
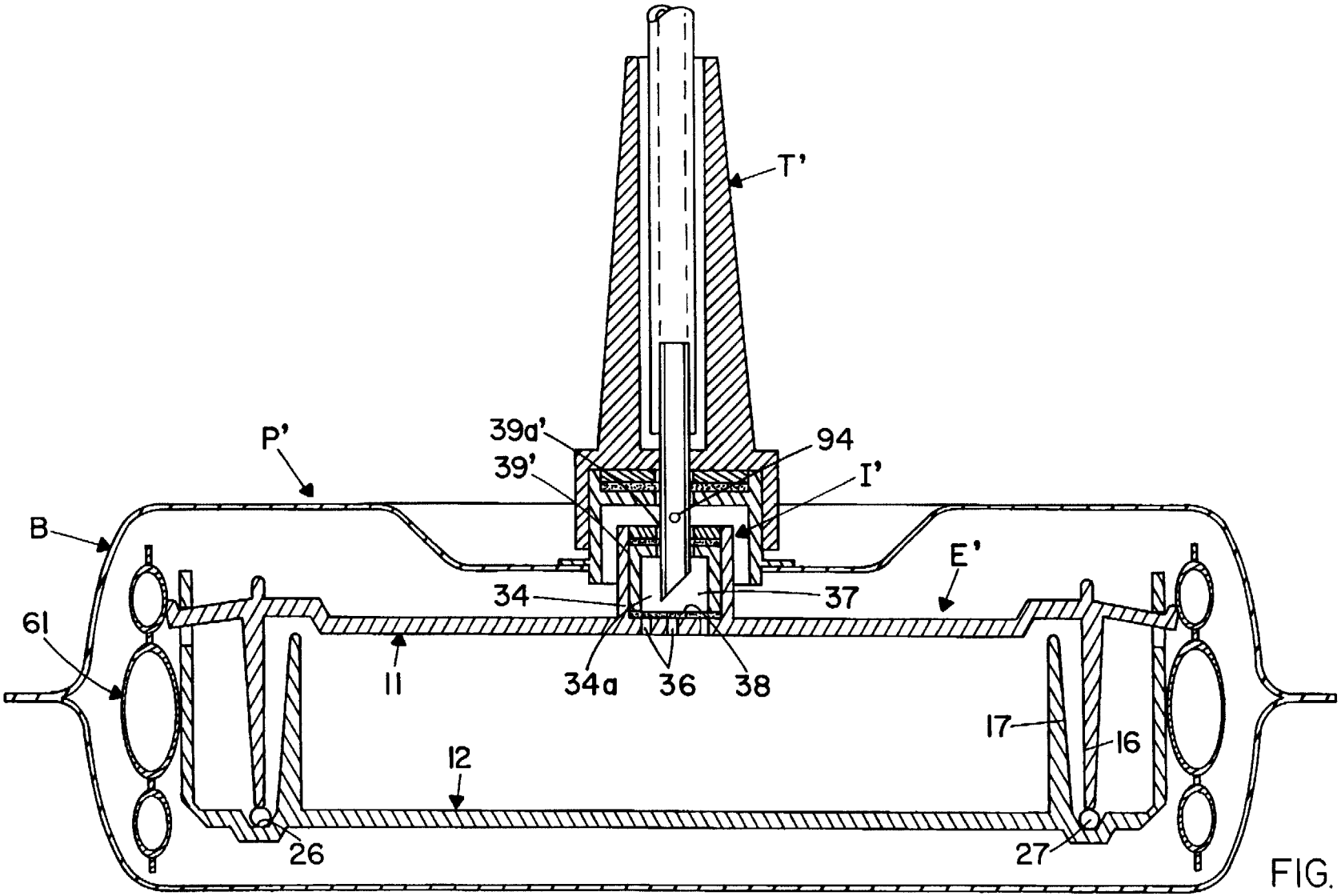
FIG. 16 is a view similar to FIG. 15 illustrating a modification of the package of the invention.

Referring now to FIG. 16, there is shown a modification of the package P of FIG. 15 designated generally by the letter P' and wherein like numerals are used to identify like parts. The package P' includes an enclosure E' having an inlet port I' which includes an upstanding sleeve 34 having a central bore 37 and preferably formed integrally with the bottom wall 13 of half-section 11. A filter 38 and filter retainer 39' having a central opening 39*a'* are disposed within the central bore 37 of sleeve 34 with the filter 38 overlying the apertures 36 in the half-section bottom wall 13. The components of the inlet port I' are those shown in broken lines in FIG. 1.

The bag B includes an inlet port 81 as shown in FIG. 13 and in the embodiment of FIG. 16, is aligned with the enclosure inlet port I' for accommodating the sleeve 34 of port I' within the central bore 83 of the sleeve 82. It will be noted that the inlet port I' does not include a patch such as the patch 41 of FIG. 5. Therefore, package sealing and resealing is obtained from the patch 90 of the bag B.

To perform a purging and/or evacuating operation in the embodiment of FIG. 16, the wand T' is positioned as shown with the bag inlet port 81 accommodated within the wand recess 47. The needle 48 extends through the apertures 88*a*, 91*a* on the bag inlet port 81 piercing the patch 90 and through aperture 39*a* in the retainer 39 of the inlet port I'. Thus, the needle port 94 communicates with the interior 19 of the enclosure E' through the filter 38 and the apertures 36 in the enclosure wall 13.

We claim:

1. A package for storing contaminant-sensitive articles in a contaminant-free environment comprising, in combination, a pair of half-sections of polymeric material, each of said half-sections having a bottom wall and a side wall, said half-sections arranged for overlying, sliding engagement from a spaced-apart, open position into a stop position with said side walls in telescoping relationship to form a closed enclosure having an interior for accommodating one or more contaminant-sensitive articles, sealing means operatively associated with at least one of said side walls for sealing said enclosure interior in said stop position, resilient clamping means on said half-sections for yieldingly urging said half-sections into said stop position against said sealing means to seal said enclosure interior and means on said enclosure for introducing a purging gas into said sealed enclosure interior to move said half-sections out of said stop position against said clamping means to thereby relieve excessive gas pressure in said enclosure interior.

2. A package in accordance with claim 1 including means for bathing said articles with an ionizing gas during the introduction of said articles into said enclosure interior.

3. A package in accordance with claim 1 wherein said half-sections are of circular cross-sectional shape.

4. A package in accordance with claim 1 wherein said each of said side walls includes an annular upper edge and wherein said sealing means comprise an O-ring mounted on one of said half-sections and wherein said upper edge on said side wall on the other of said half-sections is adapted for sealing engagement with said O-ring in said stop position to maintain said enclosure interior in a sealed condition.

5. A package in accordance with claim 1 including padding means adapted to be mounted on the outer periphery of said enclosure for cushioning said enclosure and for further reducing the introduction of contaminants within said enclosure interior.

6. A package in accordance with claim 5 wherein said padding means includes an elongated strip having ends, at least one longitudinally extending air chamber in said strip and means for interconnecting said strip ends to retain said strip in said mounted position on said enclosure.

7. A package in accordance with claim 1 wherein said resilient clamping means comprise a plurality of pivotally mounted, circumferentially spaced latch members on one of said half-sections, a plurality of circumferentially spaced, catch members on the other of said half-sections each yieldingly engageable with an associated one of said latch members for urging said half-sections into said stop position.

8. A package in accordance with claim 7 wherein each of said latch members comprises a pivotally mounted flap member formed integrally with said one half-section and having a slot for receiving said catch member.

9. A package in accordance with claim 1 wherein said means for introducing a purging gas into said enclosure comprises an inlet port on one of said half-sections and means for connecting said inlet port to associated fluid pumping apparatus having a source of purging gas.

10. A package in accordance with claim 9 wherein said fluid pumping apparatus includes a hollow needle connected to said fluid pumping source having an outlet end and wherein said inlet port includes an aperture in said one half-section bottom wall, a filter in overlying relationship with said aperture, a patch of self-sealing material in overlying, spaced-apart relationship with said filter for maintaining said enclosure interior in a sealed condition and wherein said patch is adapted for penetration by said hollow needle to introduce said purging gas in said enclosure interior through said filter and for resealing upon withdrawal of said needle to maintain said enclosure interior in a sealed condition.

11. A package in accordance with claim 1 including a sealed bag of flexible plastic material having an interior and wherein said enclosure is disposed within said bag interior and means for introducing a purging gas in said bag interior.

12. A package in accordance with claim 11 wherein said means for introducing a purging gas into said interiors of said enclosure and bag comprises an associated fluid pumping apparatus, an inlet port on said bag in operative association with said enclosure inlet port and means for connecting said inlet ports to said associated fluid pumping apparatus having a source of purging gas.

13. A package in accordance with claim 12 wherein said fluid pumping apparatus includes a vacuum source, a hollow needle connected to said fluid pumping source having an outlet end and an outlet side port and wherein said enclosure inlet port includes an aperture in said one half-section bottom wall, a filter in overlying relationship with said aperture, a patch of self-sealing material in overlying, spaced-spaced relationship with said filter for maintaining said enclosure interior in a sealed condition and wherein said bag includes a side wall and wherein said bag inlet port includes an opening in said bag side wall, a patch of self-sealing material in overlying, spaced-apart relationship with said bag opening to maintain said bag interior in a sealed condition and wherein said patches are adapted for penetration by said hollow needle to introduce one of said purging gas and said vacuum from said needle outlet end into said enclosure interior and into said bag interior through said needle side port and for resealing upon withdrawal of said needle to maintain said interiors in a sealed condition.

14. A package in accordance with claim 12 wherein said fluid pumping apparatus includes a vacuum source, a hollow needle connected to said fluid pumping source having an outlet end and wherein said enclosure inlet port includes an aperture in said one half-section bottom wall, a filter in overlying relationship with said aperture and wherein said bag includes an opening in said bag side wall, a patch of self-sealing material in overlying, spaced-apart relationship with said bag opening to maintain said bag and enclosure interiors in a sealed condition and wherein said patch is adapted for penetration by said hollow needle to introduce one of said purging gas and vacuum from said needle outlet end into said enclosure and bag interiors and for resealing upon withdrawal of said needle to maintain said interiors in a sealed condition.

* * * * *